US010328744B2

(12) United States Patent
Chang

(10) Patent No.: US 10,328,744 B2
(45) Date of Patent: Jun. 25, 2019

(54) MOTOR FIXING STRUCTURE OF ENGRAVING MACHINE

(71) Applicant: KINGSAND MACHINERY LTD., Taichung (TW)

(72) Inventor: Chin-Feng Chang, Taichung (TW)

(73) Assignee: KINGSAND MACHINERY LTD., Taichung (TW)

( * ) Notice: Subject to any disclaimer, the term of this patent is extended or adjusted under 35 U.S.C. 154(b) by 135 days.

(21) Appl. No.: 15/675,781

(22) Filed: Aug. 13, 2017

(65) Prior Publication Data

US 2019/0047321 A1 Feb. 14, 2019

(51) Int. Cl.

| | |
|---|---|
| ***B44B 1/06*** | (2006.01) |
| ***B44B 3/06*** | (2006.01) |
| *B44B 1/02* | (2006.01) |

(52) U.S. Cl.

CPC ..... *B44B 1/06* (2013.01); *B44B 3/06* (2013.01); *B44B 1/02* (2013.01); *B44B 2700/12* (2013.01)

(58) Field of Classification Search

CPC ..... B44B 1/06
USPC ..... 33/18.1
See application file for complete search history.

(56) References Cited

U.S. PATENT DOCUMENTS 2,536,650 A * 1/1951 Martinez ..... B44B 3/001 144/144.1
3,518,767 A * 7/1970 Claas ..... B44B 3/003 33/24.3
4,141,145 A * 2/1979 Schiffman ..... B23Q 35/20 33/25.1
2005/0086816 A1* 4/2005 Siegel ..... B21C 51/005 33/18.1
2007/0144018 A1* 6/2007 Tseng ..... B44B 3/063 33/32.3
2010/0058604 A1* 3/2010 Johnson ..... B44B 5/0061 33/679
2011/0283552 A1* 11/2011 Soyama ..... B28D 5/0011 33/18.1
2016/0250748 A1* 9/2016 Vaughn ..... B44B 3/00 33/18.1
2019/0047322 A1* 2/2019 Chang ..... B44B 1/06

* cited by examiner

*Primary Examiner* — George B Bennett
(74) *Attorney, Agent, or Firm* — Raymond Y. Chan; David and Raymond Patent Firm

(57) ABSTRACT

A motor fixing structure of an engraving machine is provided. A lifting platform has a through hole, at least three protruding walls spaced and arranged around the through hole, and notches each defined between every two of the protruding walls. The outer side of each notch is provided with a clamping block. The lifting platform has a radial guide hole corresponding in position to the clamping block. The clamping block has a vertical aperture. The bottom surface of the lifting platform has an adjustment seat with a peroration. The protruding walls are fitted with a turning disc. The turning disc has at least three oblique curved holes. The turning disc is pivotally connected with a shaft. A drive rod is screwed to the shaft. A quick release assembly is inserted in the corresponding oblique curved holes, the aperture and the guide hole for tightening or loosening the clamping block.

7 Claims, 11 Drawing Sheets

MOTOR FIXING STRUCTURE OF ENGRAVING MACHINE

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a motor fixing structure of an engraving machine, and more particularly to a lifting platform having at least three clamping blocks for quickly locking various sized motors.

Description of Related Arts

As shown in FIG. 1 to FIG. 5, a conventional engraving machine includes a platform 11 suspended in a mounting trough 2 of a worktable 1. The platform 11 has a blade hole 111 and a receiving hole 113 for insertion of a wrench 112. A plurality of screw rods 12 is vertically provided under the bottom surface of the platform 11. The screw rods 12 are arranged in parallel with each other. The blade hole 111 is located among the screw rods 12. A lifting platform 13 is located under the platform 11. The lifting platform 13 is provided with pivot holes 131 corresponding in position to the screw rods 12. Each pivot hole 131 is provided with a screw seat 132 for engagement of the screw rod 12. The lifting platform 13 has a connecting hole 133 corresponding in position to the receiving hole 113. The connecting hole 133 is mounted with a rotatable shaft seat 134. Each of the screw seats 132 and the shaft seat 134 is provided with a sprocket 135. The sprockets 135 are connected by a chain 16. The lifting platform 13 has a through hole 136 corresponding in position to the blade hole 111 and screws 137 around the through hole 136. The bottom end of each screw 137 is connected with a press plate 138. Through the press plates 138 screwed to the screws 137, the bottom surface of the lifting platform 13 is mounted with a jig 14. The jig 14 has a plurality of screw holes 141 spaced at a different interval for mounting a motor 15 which may be different in size to the bottom surface of the lifting platform 13. A rotary shaft 151 of the motor 15 is provided with a cutter 152. When the sprocket 135 of the shaft seat 134 is rotated by the wrench 112, the sprockets 135 of the screw seats 132 are rotated through the chain 16 so that the lifting platform 13 is lifted and lowered along the screw rods 12 to adjust the height that the cutter 152 of the motor 15 extends out of the blade hole 111 for engraving the wood. However, the above structure has the following problems:

1. The screw holes 141 of the jig 14 are spaced at a different interval for mounting various sized motors 15 to the bottom surface of the lifting platform 13. For mounting the motor 15, it is necessary to use other tools. It is not convenient when the engraving machine 10 needs replacing a motor 15 with a different speed or power.

2. The motor 15 is mounted to the suitable screw holes 141 according to its size, but it is not sure whether the rotary shaft 151 of the motor 15 is located at the center of the lifting platform 13. Even if the cutter 152 is only slightly deviated, the precision and accuracy of engraving the wood may be affected.

Accordingly, the inventor of the present invention has devoted himself based on his many years of practical experiences to solve these problems.

SUMMARY OF THE PRESENT INVENTION

The primary object of the present invention is to solve the aforesaid problems and to provide a motor fixing structure of an engraving machine. A lifting platform of the engraving machine has a circular through hole, at least three protruding walls spaced and arranged around the through hole, and notches each defined between every adjacent two of the protruding walls. A clamping block is provided in the vicinity of each notch, which is movable in a radial direction. The protruding walls are fitted with a turning disc. The turning disc has oblique curved holes each corresponding in position to the clamping block. A quick release assembly is inserted in a corresponding one of the oblique curved holes and the clamping block to be connected to the lifting platform for tightening or loosening the clamping block. The turning disc is driven by a drive rod to rotate, so that the oblique curved holes are rotated and displaced to move the clamping blocks inward or outward. With the above-described structure, the motor can be quickly assembled or disassembled. The present invention is used for mounting various sized motors.

DETAILED DESCRIPTION OF THE PREFERRED EMBODIMENT

Figure 1:
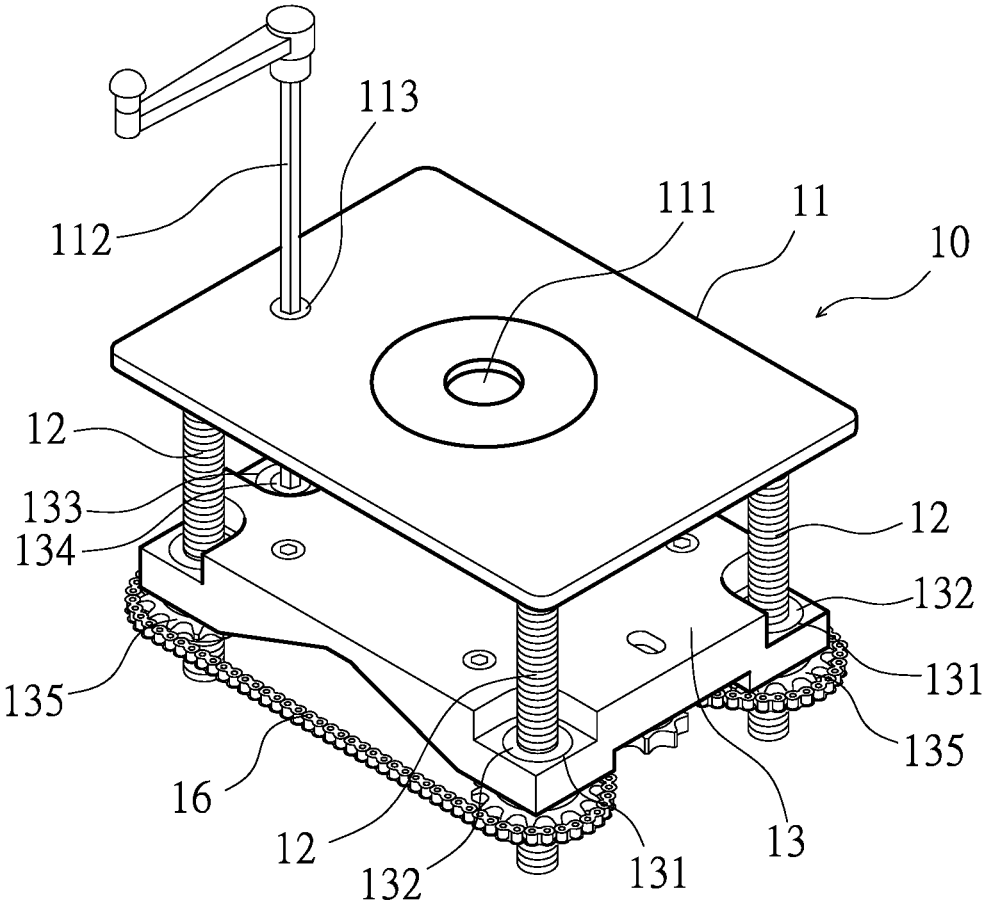
PRIOR ART FIG.1
FIG. 1 is a perspective view of a conventional engraving machine.
Figure 2:
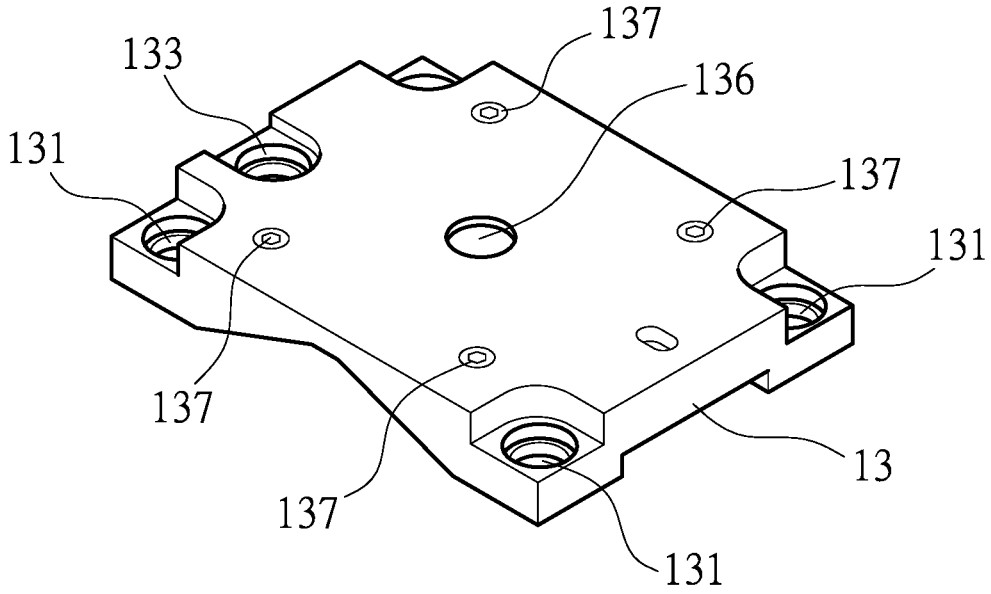
PRIOR ART FIG.2
FIG. 2 is a front perspective view of a conventional lifting platform.
Figure 3:
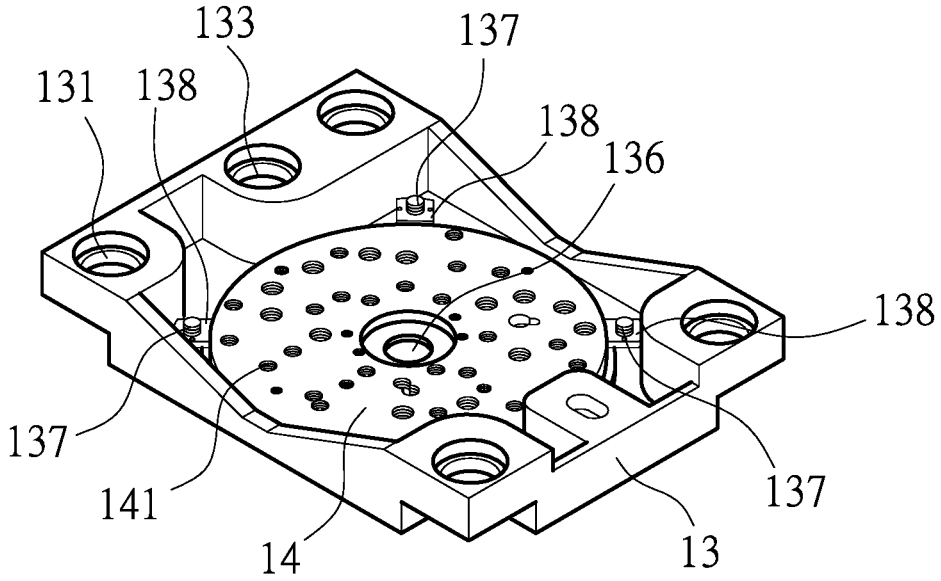
PRIOR ART FIG.3
FIG. 3 is a bottom perspective view of the conventional lifting platform.
Figure 4:
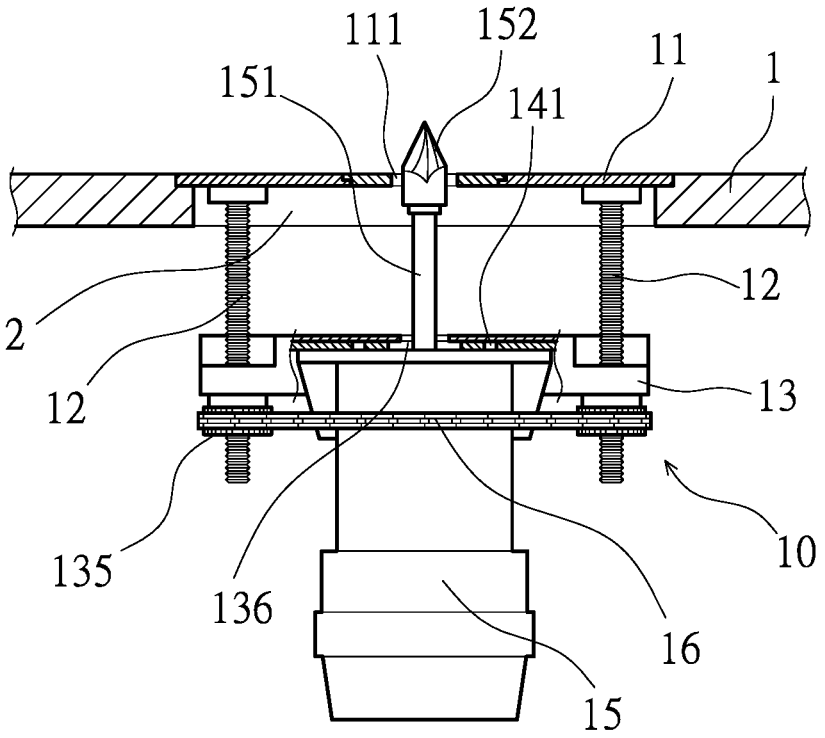
PRIOR ART FIG.4
FIG. 4 is a sectional view of the conventional lifting platform mounted to a worktable.
Figure 5:
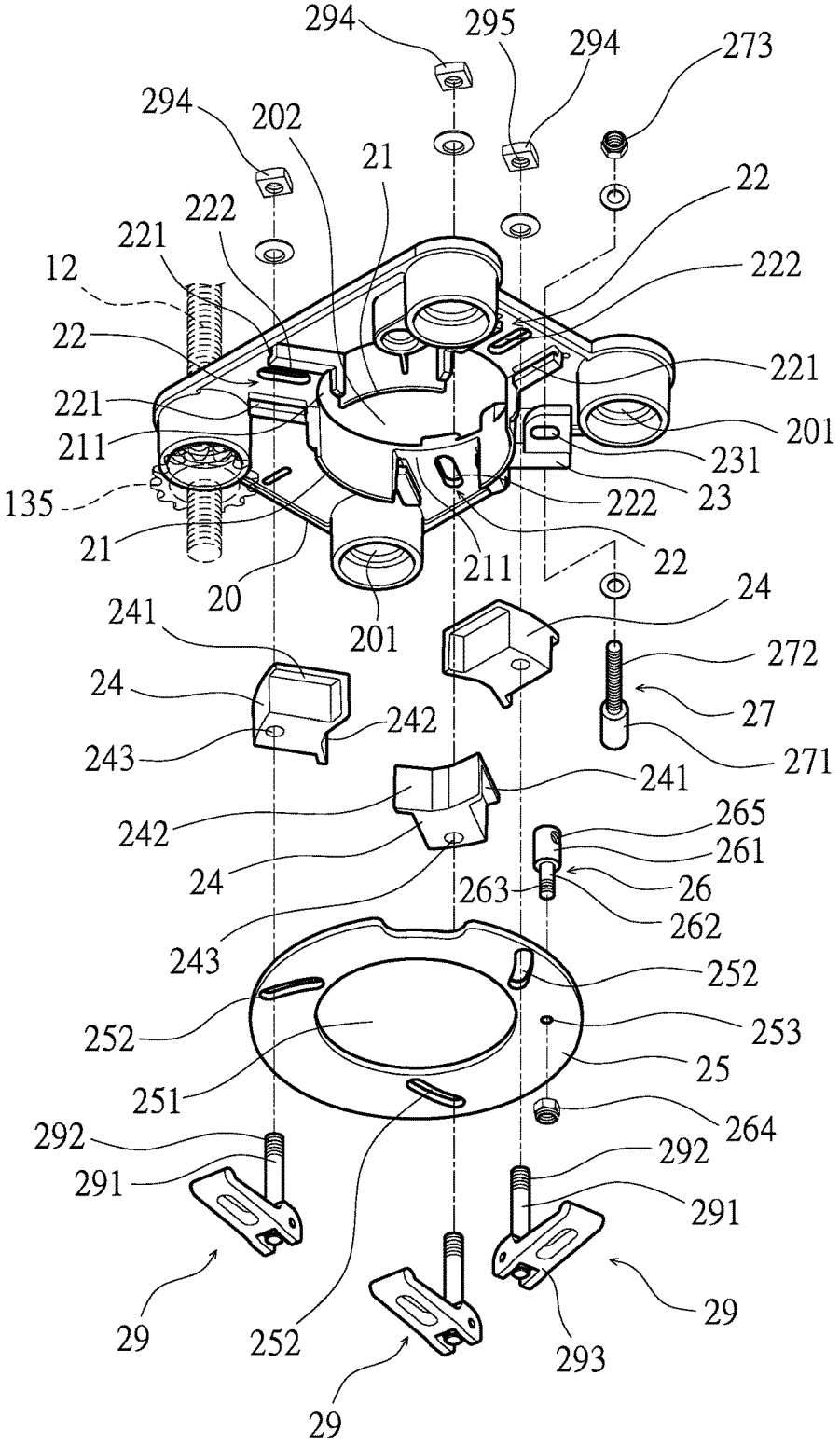
FIG. 5 is a perspective view of the present invention.
Figure 6:
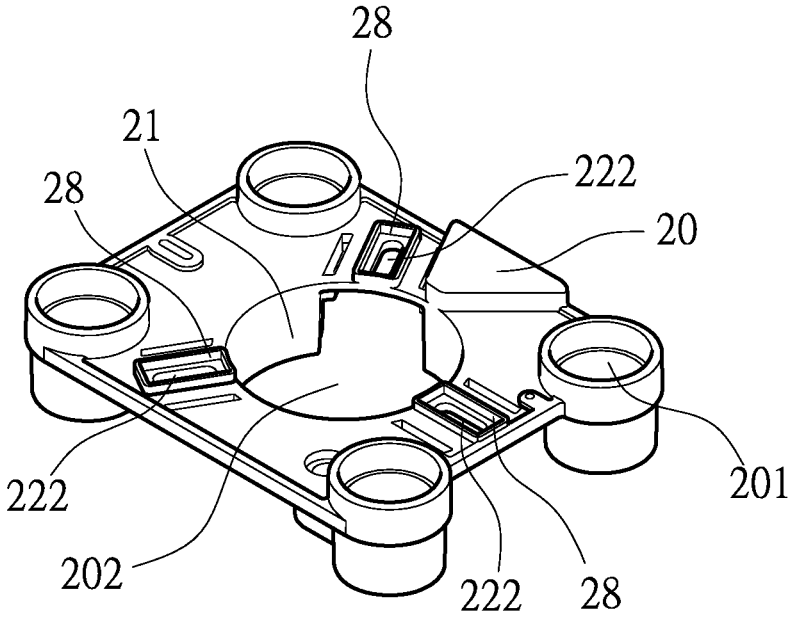
FIG. 6 is a front perspective view of the lifting platform of the present invention.
Figure 7:
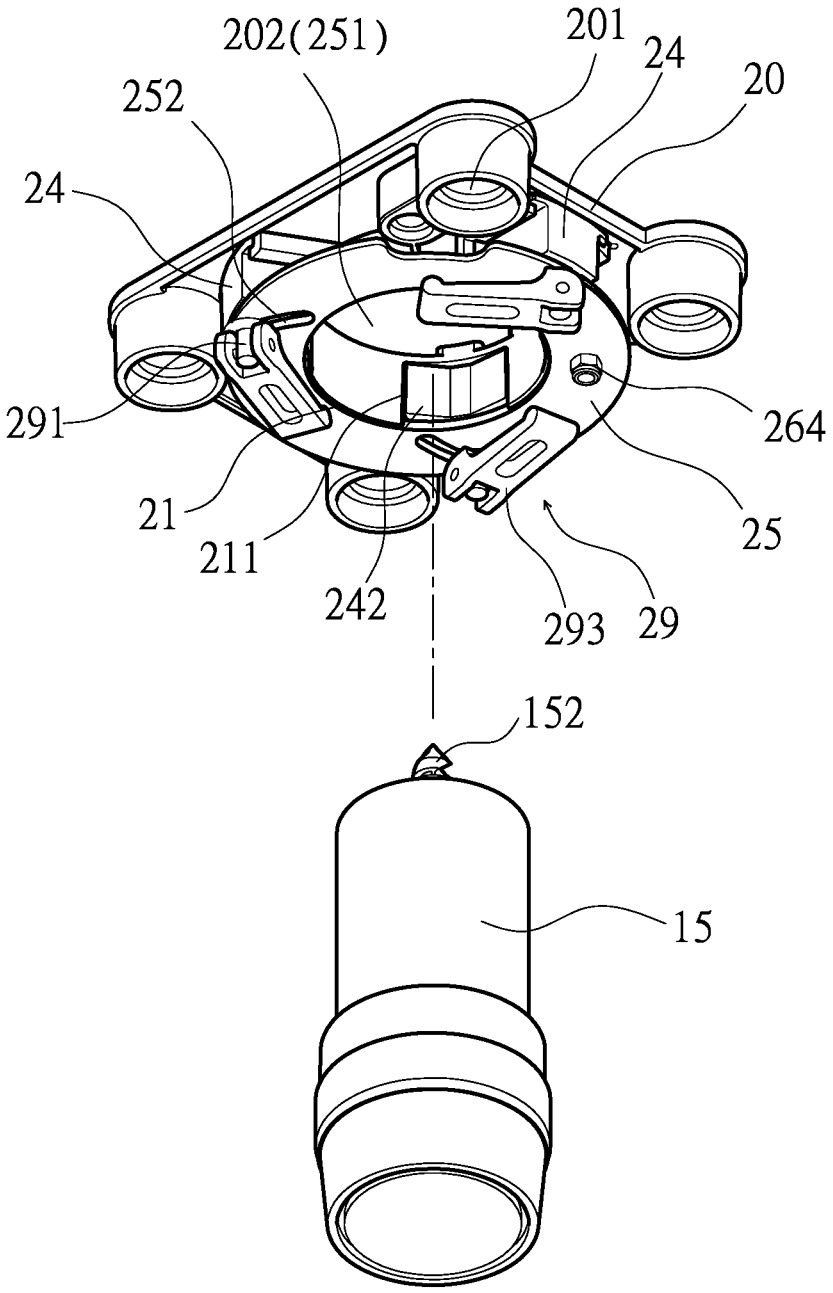
FIG. 7 is a perspective view of the lifting platform mounted with the motor of the present invention.

Embodiments of the present invention will now be described, by way of example only, with reference to the accompanying drawings.

Referring to FIG. 5 to FIG. 11, a peripheral portion of a lifting platform 20 of an engraving machine is provided with a plurality of pivot holes 201. The lifting platform 20 is provided with a circular through hole 202, at least three protruding walls 21 extending downward from the through hole 202 and arranged around the through hole 202, and notches 211 each defined between every adjacent two of the protruding walls 21. A bottom surface of the lifting platform 20, corresponding in position to the outer sides of the notches 211, is provided with engaging portions 22 each having a pair of rail grooves 221 at two sides thereof. The engaging portion 22 is provided with a radial guide hole 222 penetrating the lifting platform 20. The bottom surface of the lifting platform 20 is provided with an adjustment seat 23 protruding downward between every two of the engaging portions 22 and close to a corresponding one of the protruding walls 21. The adjustment seat 23 has a transverse perforation 231. The engaging portion 22 is connected with a clamping block 24. Two sides of the clamping block 24 are provided with side flanges 241 to be movably engaged in the rail grooves 221, so that the clamping block 24 can be reciprocated back and forth in the engaging portion 22. The clamping block 24 has a clamping surface 242 facing the notch 211 and an aperture 243 vertically penetrating the clamping block 24 and corresponding in position to the guide hole 222. The protruding walls 21 are fitted with a turning disc 25. The turning disc 25 has a central fitting hole 251 and is rotatably connected to the protruding walls 21. The turning disc 25 is provided with at least three oblique curved holes 252 each corresponding in position to the aperture 243 and the guide hole 222. The turning disc 25 further has a shaft hole 253. The shaft hole 253 is pivotally connected with a shaft 26. The shaft 26 has a head portion 261 and a shaft rod 262. A lower end of the shaft rod 262 is formed with a threaded portion 263. The shaft rod 262 is inserted in the shaft hole 253 from the top of turning disc 25, and a nut 264 is screwed to the threaded portion 263 at the lower end of the shaft rod 262. The head portion 262 is provided with a transverse screw hole 265 corresponding in position to the perforation 231. A drive rod 27 is inserted through the perforation 231 and screwed to the screw hole 265 of the head portion 261 of the shaft 26. The drive rod 27 includes a drive head 271 and an adjustment screw rod 272. After the adjustment screw rod 272 is inserted through the perforation 231, a positioning nut 273 is screwed to the adjustment screw rod 272 so that the adjustment seat 23 is sandwiched between the drive head 271 and the positioning nut 273. The drive rod 27 is idle in the perforation 231 to screw the shaft 26 to turn the turning disc 25. A top surface of the lifting platform 20 is provided with limit grooves 28 each corresponding in position to the guide hole 222. The limit grooves 28 are arranged radially and have a rectangular shape. A quick release assembly 29 is inserted in a corresponding one of the oblique curved holes 252, the aperture 243 of the clamping block 24, and the guide hole 222 of the lifting platform 20. The quick release assembly 29 includes a rod 291, a threaded section 29 at a top end of the rod 291, and an eccentric lever 293 at a bottom end of the rod 291. A square locking block 294 having a threaded hole 295 is provided in each of the limit grooves 28. The locking block 294 is slidable in the limit groove 28 but can not be rotated. The rod 291 is inserted from the bottom surface of the turning disc 25 to pass through the oblique curved hole 252, the aperture 243 and the guide hole 222, and is screwed to the threaded hole 295 of the locking block 294. The locking block 294 is unable to rotate, so that the eccentric lever 293 at one end of the quick release assembly 29 is rotated to connect the rod 291 with the threaded hole 295 of the locking block 294. The eccentric lever 293 may be pulled to tighten or loosen the clamping block 24. According to the above-described structure, the shaft 26 is rotated by rotating the drive rod 27 to turn the turning disc 25, thereby displacing the oblique curved hole 252 to move the rod 291 of the quick release assembly 29 in the guide hole 222, so that the clamping blocks 24 can be synchronously moved inward or outward to clamp or release a different sized motor.

Figure 8:
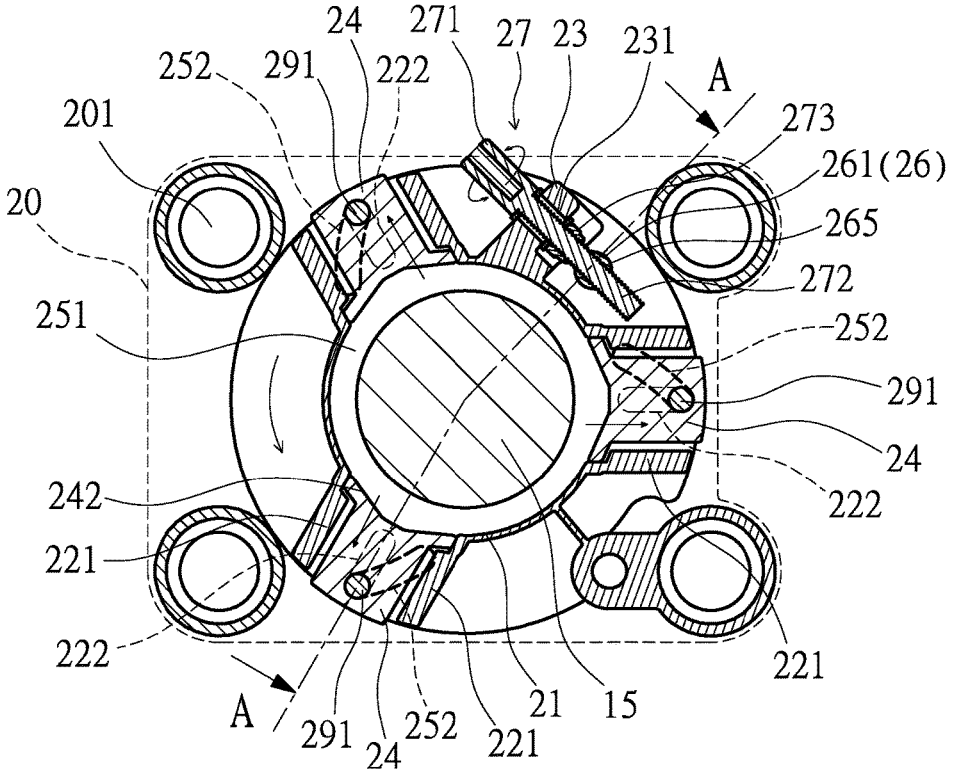
FIG. 8 is a top sectional view of the present invention, showing that the clamping blocks are moved outward to release the motor.
Figure 9:
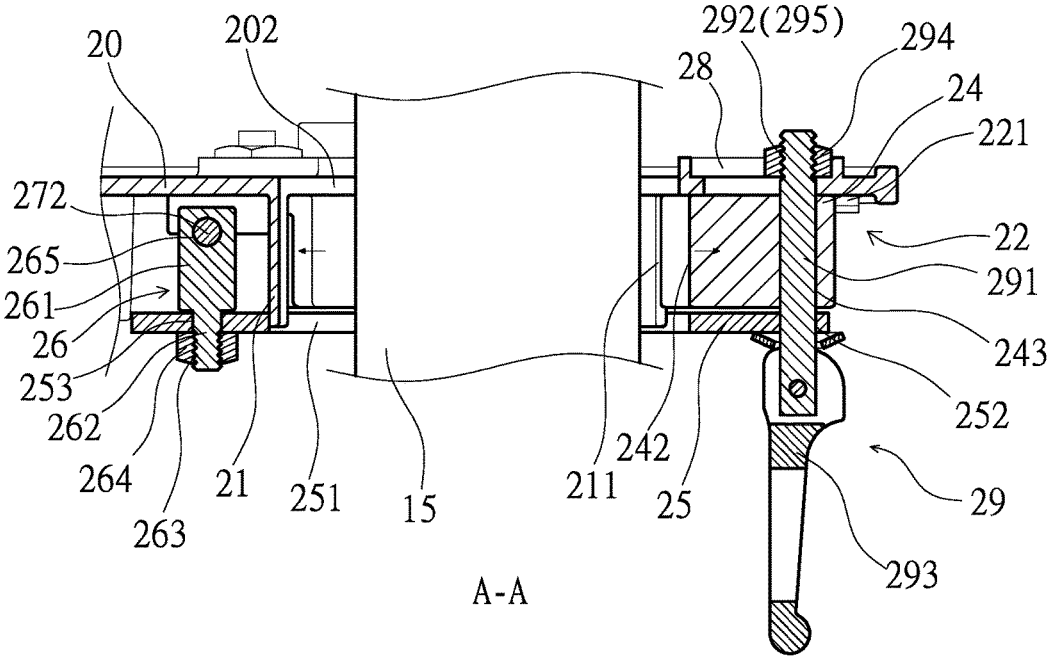
FIG. 9 is a side sectional view of the present invention, showing that the clamping blocks are moved outward to release the motor.
Figure 10:
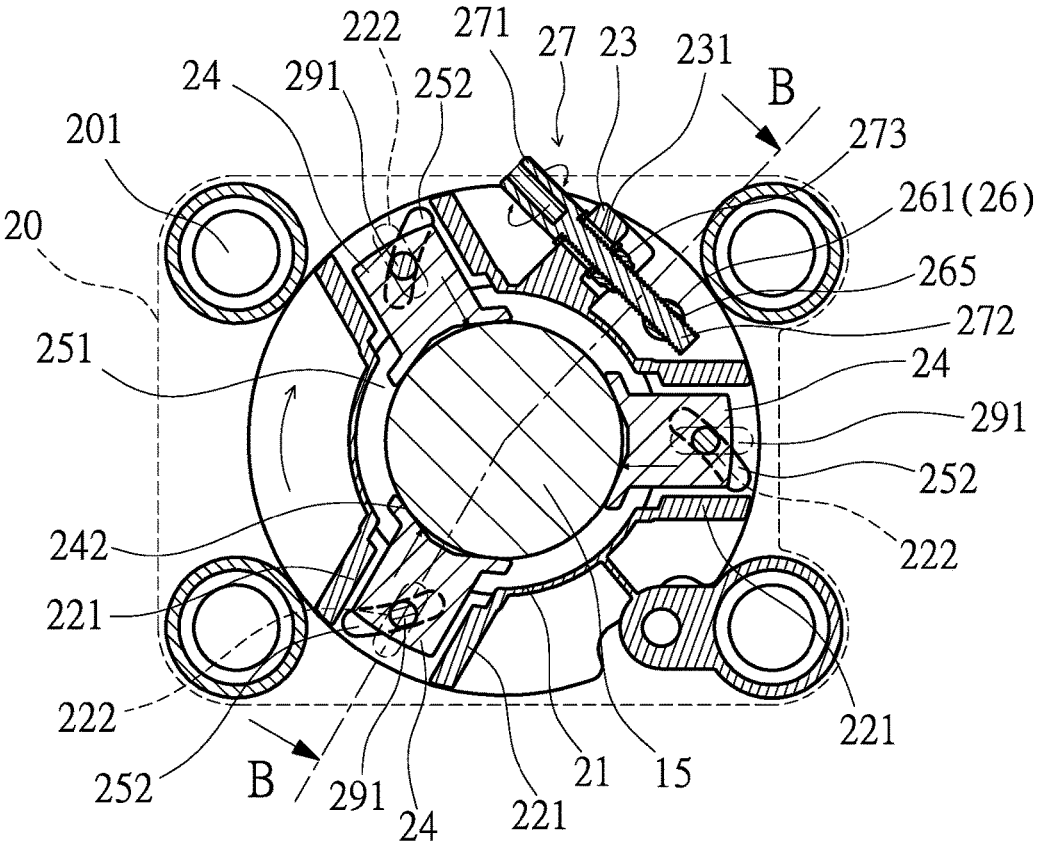
FIG. 10 is a top sectional view of the present invention, showing that the clamping blocks are moved inward to clamp the motor.
Figure 11:
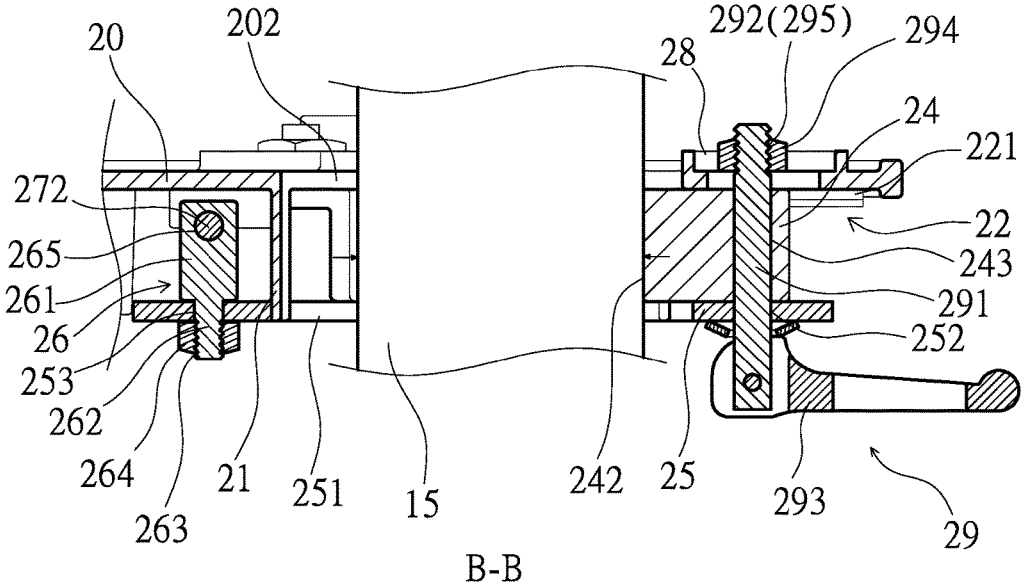
FIG. 11 is a side sectional view of the present invention, showing that the clamping blocks are moved inward to clamp the motor.

The assembly, function and the details of the above-described embodiment are described hereinafter. Referring to FIG. 5 to FIG. 11, in this embodiment, the oblique curved holes 252 are evenly arranged on the turning disc 25 counterclockwise. When the motor 15 is mounted in the through hole 202 and the fitting hole 251, the turning disc 25 is driven to rotate clockwise. The aperture 243 makes the rod 291 to be perpendicular to the clamping block 24. The rods 291 which are only radially movable in the oblique curved holes 252 are brought to the inner side of the turning disc 25, and the rods 291 drive the clamping blocks 24 to synchronously clamp the motor 15. On the contrary, when the turning disc 25 is driven to rotate counterclockwise, the rods 291 which are only radially movable in the oblique curved holes 252 are brought to the outer side of the turning disc 25, and the rods 291 drive the clamping blocks 24 to synchronously release the motor 15. The clamping blocks 24 synchronously clamp the motor 15, so the cutter 152 of the motor 15 is located at the center of the through hole 202. That is, the cutter 152 of the motor 15 can be easily mounted in the central position, thereby providing better precision and accuracy for engraving the wood. When it is necessary to replace a different sized motor 15, the eccentric lever 293 of the quick release assembly 29 is pulled to be in a non-tightened state to loosen the clamping block 24. The drive head 271 of the drive rod 27 is turned to drive the shaft 26, and then the shaft 26 drives the turning disc 25 to turn counterclockwise, while, the shaft 26 is rotated to cooperate with the direction of the adjustment screw rod 272. The diameter of the perforation 231 is greater than that of the adjustment screw rod 272. The perforation 231 is in the form of an elongate hole to provide a sufficient space for the drive rod 27 to cooperate with the shaft 26. The turning disc 25 is rotated counterclockwise so that the oblique curved holes 252 bring the rods 291 of the quick release assemblies 29 and the clamping blocks 24 to the outer side of the turning disc 25 (as shown in FIG. 8 and FIG. 9). The clamping surfaces 242 of the clamping blocks 24 are synchronously moved away from the through hole 202 to release the motor 15 for the replacement of another motor. After the motor is replaced, the drive head 271 of the drive rod 27 is rotated to drive the shaft 26 so that the shaft 26 drives the turning disc 25 to rotate clockwise. The oblique curved holes 252 of the turning disc 25 bring the rods 291 of the quick release assemblies 29 and the clamping blocks 24 to the inner side of the turning disc 25 (as shown in FIG. 10 and FIG. 11), so that the clamping surfaces 242 of the clamping blocks 24 synchronously clamp the motor 15. The larger the rotational angle of the turning disc 25 is, the greater the displacement of the clamping blocks 24 is. Therefore, it is only required to adjust the rotational angle of the turning disc 25 so that the present invention is used for mounting various sized motors. Finally, the eccentric lever 293 of the quick release assembly 29 is pulled to be in a tightened state to secure the clamping block 24 in a quick manner.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A motor fixing structure of an engraving machine, a lifting platform of the engraving machine having a circular through hole, at least three protruding walls extending downward from said through hole and arranged around said through hole, and notches each defined between every adjacent two of said protruding walls, a bottom surface of said lifting platform, corresponding in position to outer sides of said notches, being provided with engaging portions each having a pair of rail grooves at two sides thereof, said engaging portions each having a radial guide hole penetrating said lifting platform; said bottom surface of said lifting platform being provided with an adjustment seat protruding downward between every two of said engaging portions and close to a corresponding one of said protruding walls, said adjustment seat having a transverse perforation; each of said engaging portions being connected with a clamping block, two sides of said clamping block having side flanges to be movably engaged in said rail grooves, said clamping block having a clamping surface facing a corresponding one of said notches and an aperture vertically penetrating said clamping block and corresponding in position to said guide hole; said protruding walls being fitted with a turning disc, said turning disc having a central fitting hole and being rotatably connected to said protruding walls, said turning disc being provided with at least three oblique curved holes each corresponding in position to said aperture and said guide hole, said turning disc being pivotally connected with a shaft, said shaft being provided with a transverse screw hole corresponding in position to said perforation, a drive rod being inserted through said perforation and screwed to said screw hole of said shaft, said drive rod being idle in said perforation to screw said shaft to turn said turning disc; a quick release assembly being inserted in a corresponding one of said oblique curved holes, said aperture of said clamping block, and said guide hole of said lifting platform, said quick release assembly including a rod, a threaded section at a top end of said rod, and an eccentric lever at a bottom end of said rod, said rod passing through said corresponding oblique curved hole, said aperture and said guide hole, a top surface of said lifting platform being provided with a locking block having a threaded hole to mesh with said threaded section of said rod, said eccentric lever being pulled to tighten or loosen said clamping block.

2. The motor fixing structure of the engraving machine, as recited in claim 1, wherein said turning disc has a shaft hole, said shaft has a head portion and a shaft rod, a lower end of said shaft rod is formed with a threaded portion, said shaft rod is pivotally connected to said shaft hole, a nut is screwed to said threaded portion at said lower end of said shaft rod, and said screw hole of said shaft is disposed in said head portion.

3. The motor fixing structure of the engraving machine, as recited in claim 2, wherein said drive rod includes a drive head and an adjustment screw rod, after said adjustment screw rod is inserted through said perforation, a positioning nut is screwed to said adjustment screw rod, and said drive rod is meshed with said screw hole of said shaft.

4. The motor fixing structure of the engraving machine, as recited in claim 1, wherein said top surface of said lifting platform is provided with a radial limit groove corresponding in position to said guide hole, and said locking block is accommodated in said limit groove.

5. The motor fixing structure of the engraving machine, as recited in claim 4, wherein said limit groove has a rectangular shape, and said locking block has a square shape so that said locking block is unable to rotate in said limit groove.

6. The motor fixing structure of the engraving machine, as recited in claim 1, wherein said perforation has a diameter greater than that of said adjustment screw rod.

7. The motor fixing structure of the engraving machine, as recited in claim 1, wherein said perforation is in the form of an elongate hole.

* * * * *